United States Patent [19]

Sumida

[11] Patent Number: 4,605,054

[45] Date of Patent: Aug. 12, 1986

[54] CASTING APPARATUS INCLUDING A CONDUCTOR FOR ELECTROMAGNETIC INDUCTION HEATING

[75] Inventor: Akio Sumida, Yao, Japan

[73] Assignee: Kawachi Aluminium Casting Co., Ltd., Osaka, Japan

[21] Appl. No.: 654,589

[22] Filed: Sep. 26, 1984

[30] Foreign Application Priority Data

| | | | |
|---|---|---|---|
| Sep. 26, 1983 | [JP] | Japan | 58-177577 |
| Oct. 26, 1983 | [JP] | Japan | 58-200494 |
| Jan. 27, 1984 | [JP] | Japan | 59-13575 |

[51] Int. Cl.[4] ..... B22D 27/02

[52] U.S. Cl. ..... 164/147.1; 164/513

[58] Field of Search ..... 164/513, 250.1, 147.1, 164/338.1, 500, 492, 493

[56] References Cited

U.S. PATENT DOCUMENTS

| | | | |
|---|---|---|---|
| 475,498 | 5/1892 | Fraley | 148/3 |
| 1,844,701 | 2/1932 | Tama | 164/493 |
| 1,926,573 | 9/1933 | Willcox | 164/513 |
| 1,934,901 | 11/1933 | Witting | 164/493 |
| 1,966,615 | 7/1934 | Croning | 164/493 |

FOREIGN PATENT DOCUMENTS

| | | | |
|---|---|---|---|
| 225860 | 2/1963 | Austria | 164/493 |
| 51-52332 | 5/1976 | Japan | 164/147.1 |

*Primary Examiner*—Nicholas P. Godici
*Assistant Examiner*—J. Reed Batten, Jr.
*Attorney, Agent, or Firm*—Edwin E. Greigg

[57] ABSTRACT

A casting apparatus comprising a member defining a molding space, and at least one conductor for electromagnetic induction heating mounted on the member at positions away from the molding space, the conductor being electrified to generate electromagnetic induction heat for a molten metal poured into the molding space.

4 Claims, 4 Drawing Figures

CASTING APPARATUS INCLUDING A CONDUCTOR FOR ELECTROMAGNETIC INDUCTION HEATING

BACKGROUND OF THE INVENTION

This invention relates to a casting apparatus useful for shaping long plate-like objects which are thin and have a large area such as curtain walls and reliefs.

According to conventional practice, molten metal heated to a predetermined temperature is poured into a molding space defined by a mold shaping member such as molding sand. This prior art practice has the following problem:

Fluidity of the molten metal poured into the molding space is prone to influences of an attaching angle and a shape of a mold, a shape of a pouring gate, viscosity, surface tension, and thermal properties of the molten metal and the mold (such as a quantity of heat retained by the molten metal, a latent heat of solidification, specific heat, and density of the molten metal, and various thermal factors relating to the cooling power of the mold.). Therefore, where the molten metal is maintained at a predetermined temperature only before pouring, as described above, the molten metal solidifies in the molding space within a very short time which results in a short extension of the material and which sets an inevitable limitation to the thinness and length of casting products. Summary of the Invention This invention has been made in order to solve the above problem in respect of both efficiency and economy.

Therefore, a main object of this invention is to provide a casting apparatus comprising a member defining a molding space, and a conductor for electromagnetic induction heating mounted on the member at a position away from the molding space, the conductor being electrified to generate electromagnetic induction heat for a molten metal poured into the molding space.

Another object of this invention is to provide a casting apparatus comprising a mold defining a molding space, and an electromagnetic coil mounted on an insulating material surrounding the mold in a spaced away relationship.

A further object of this invention is to provide a casting apparatus comprising an electromagnetic heating coil and a molten metal propelling means both surrounding a molding space through an insulating material.

According to this invention and particularly a main embodiment thereof to be described hereinafter, when the conductor is electrified to generate lines of magnetic force, a plurality of eddy currents are generated at positions where the lines of magnetic force cross molten metal poured into the molding space, the eddy currents creating electric resistance and rapidly heating the molten metal directly to a predetermined temperature.

Therefore, the temperature of the molten metal poured into the molding space is controlled with high precision to be a predetermined temperature, thereby maximizing the flow extension of the molten metal. This permits curtain walls and other long plate-like objects which are thin and have a large area to be shaped in a reliable and satisfactory manner. Moreover, since the molten metal is heated directly according to this invention, not only the heating time is short but heat loss is small compared with the case where, for example, an electroconductive member for defining the molding space is subjected to electromagnetic induction heating and the molten metal is heated indirectly. Thus the invention produces the above-noted effect in respect of both efficiency and economy.

Other objects and advantages of this invention will be apparent from the following description.

DETAILED DESCRIPTION OF THE INVENTION

Figure 1:
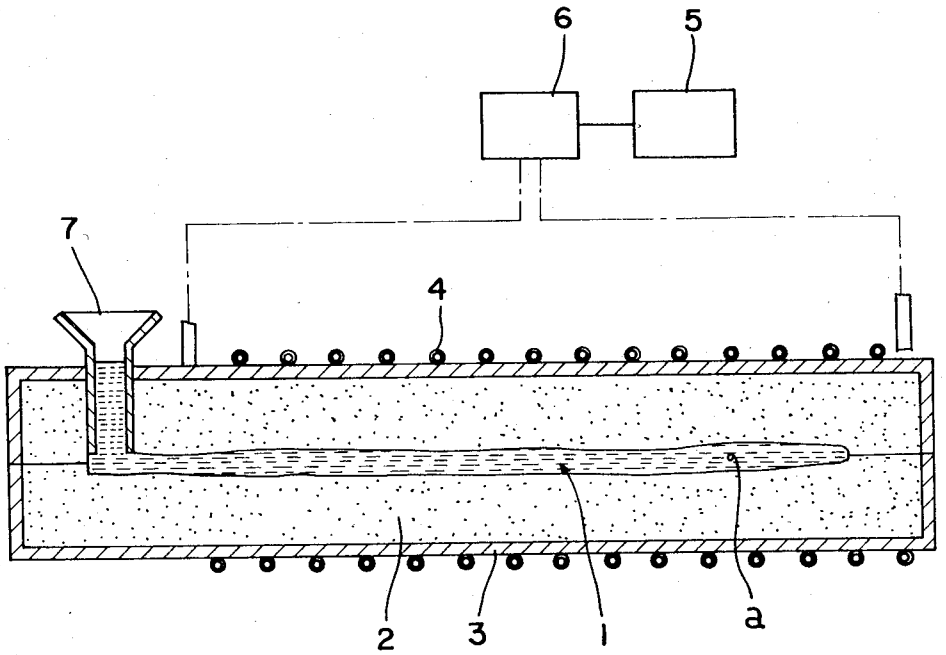
FIG. 1 is a sectional view of a first embodiment.

A first embodiment of the invention will be described hereinafter with reference to FIG. 1.

A casting apparatus shown comprises a mold frame 3 formed of a non-magnetic material and containing molding sand 2 (which is an example of shaping member) for defining a molding space 1. A conductor 4 for electromagnetic induction heating is coiled around the periphery of the mold frame 3 and is connected to an AC power source 5 through a transformer 6.

When the conductor 4 is charged with an AC current to generate lines of magnetic force, a plurality of eddy currents are generated at positions where the lines of magnetic force cross a molten metal a which has been introduced from a pouring gate 7 into the molding space 1, the eddy currents creating electric resistance and heating the molten metal a directly to a predetermined temperature.

Figure 4:
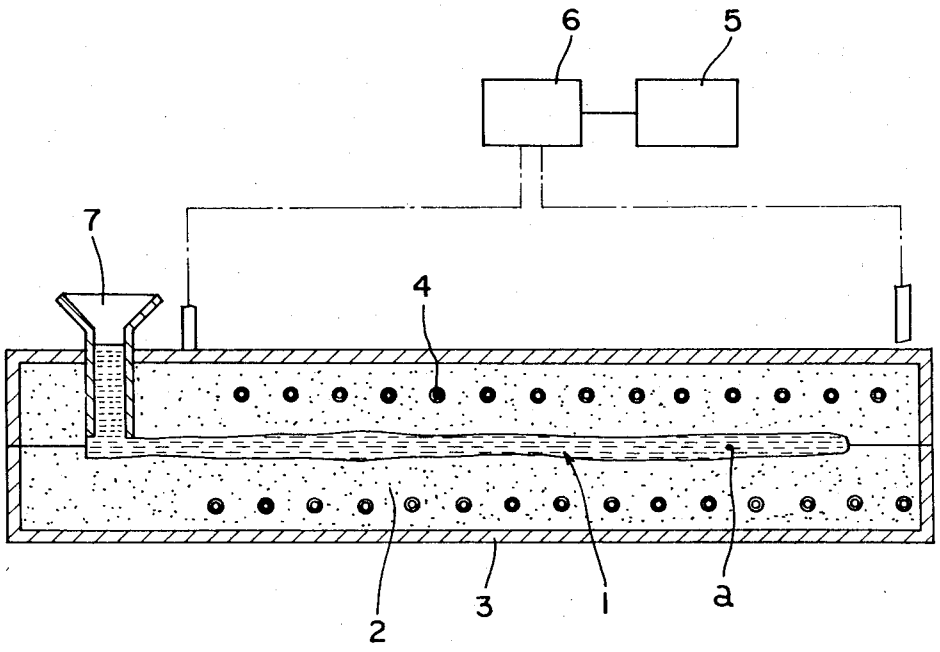
FIG. 4 shows an improved embodiment of the first embodiment.

The above embodiment may be modified in varied ways, as follows:

(a) The conductor 4 for electromagnetic induction heating is disposed within the molding sand, as shown in FIG. 4.

(b) The whole of molten metal poured into the molding space 1 may be heated by the conductor 4, but it may be modified such that the heating temperature is partially differentiated according to differences in thermal properties in a direction of flow of the molten metal in order that the molten metal a solidifies substantially uniformly in the molding space 1.

(c) A material other than molding sand is employed as the shaping member 2.

(d) The heating temperature produced by the conductor 4 for electromagnetic induction heating is variable as desired.

(e) The heating temperature produced by the conductor 4 is controlled by a microcomputer and its controlled state is displayed on a CRT.

Figure 2:
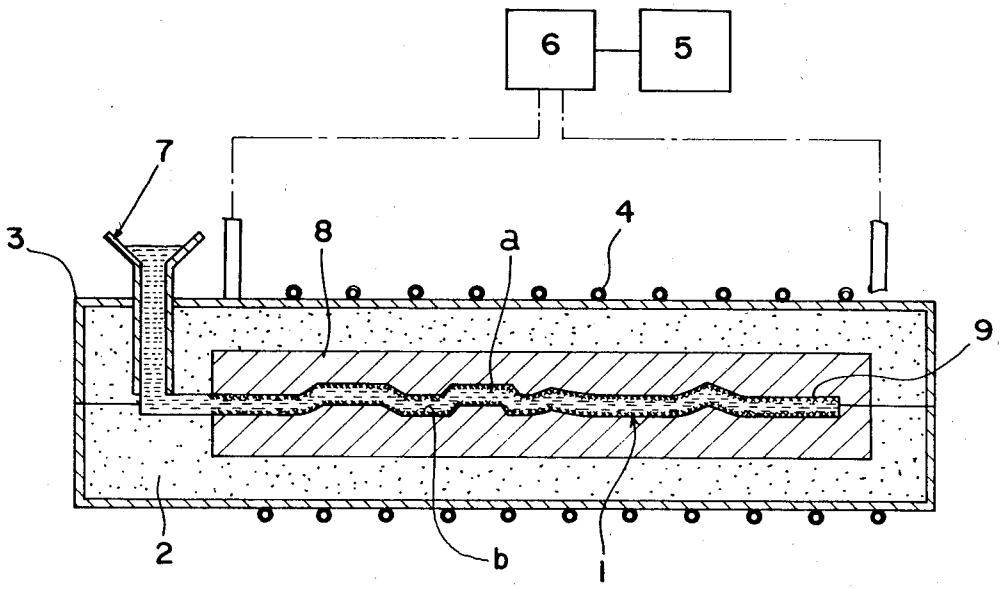
FIG. 2 is a sectional view of a second embodiment.

Referring to FIG. 2, a second embodiment differs from the first embodiment in that the molding space is defined by a mold 8 as shown. Thus the conductor or electromagnetic coil 4 not only heats the molten metal a in a direct manner but also heats the molten metal a in an indirect manner by heating the mold 8. The mold 8 may have a surface coated with metal powder b which forms an alloy with the molten metal a.

The mold 8 comprises an electroconductive powder caked by a caking agent. The electroconductive powder may be metal powder such as iron powder and stainless steel powder, or carbon powder.

This embodiment has an advantage that, where the molten metal a is aluminium and the metal powder b is copper which has a higher melting point than aluminium, a protective alloy layer of aluminium bronze is readily formed on the inner surface of the mold 8 at the melting temperature of copper after pouring in the molten metal a. Combinations other than that of aluminium and copper may be possible. Compared with the case of forming a protective alloy layer by a different apparatus, this embodiment permits heat retained by the molten metal a to be utilized as an auxiliary heat source for heating the mold, which greatly saves the power consumed by the heating means thereby achieving the hereinbefore noted effect economically.

Figure 3:
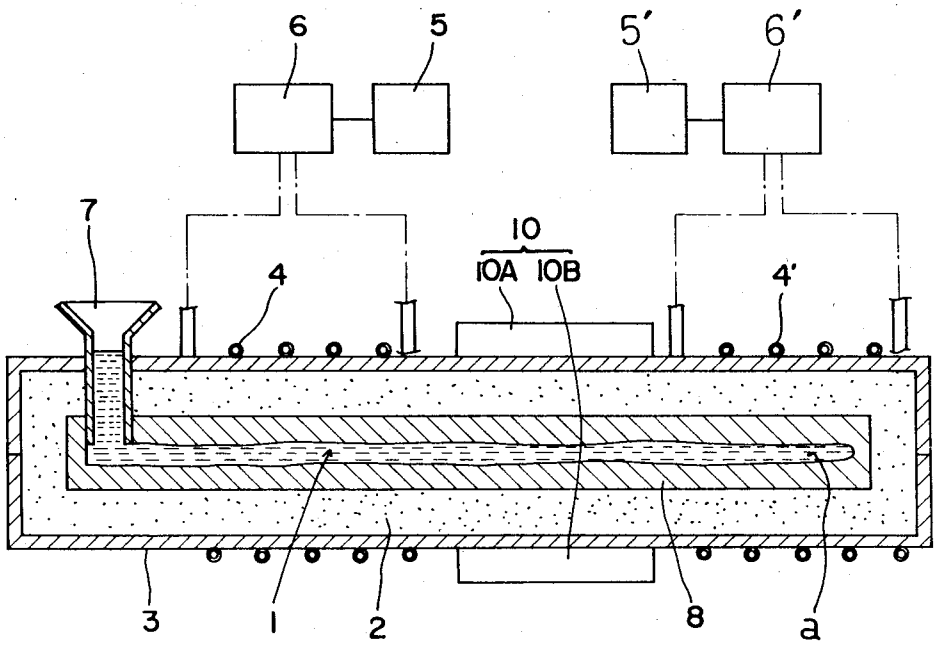
FIG. 3 is a sectional view of a third embodiment.

Referring to FIG. 3, a third embodiment differs from the two foregoing embodiments in that an electromagnetic device 10 is interposed between two electromagnetic coils 4 and 4' as shown. The coils are connected to AC power sources 5 and 5' through transformers 6 and 6', respectively, whereby temperatures at a region adjacent a pouring gate 7 and at a region remote therefrom may be controlled to be different predetermined temperatures.

More particularly, as shown in FIG. 3, the third embodiment includes the electromagnetic device 10 mounted peripherally of a mold frame 3 to forcibly advance a molten metal a toward a deep end of a molding space 1 in the mold 8, which molten metal a has been poured into the molding space 1 from a pouring gate 7. This device 10 comprises two magnets 10A and 10B mounted across the mold 8 to generate lines of magnetic force in a magnetic field therebetween and transmit electric currents in a direction normal to a direction of flow of the molten metal a. Thus the device 10 utilizes Fleming's left-hand rule to forcibly advance the electroconductive molten metal a in the direction normal to the electric currents and lines of magnetic force, namely toward the deep end of the molding space 1, at a predetermined velocity.

A further electromagnetic device may be provided to apply controls in a direction opposite to the above-mentioned direction, to the molten metal a which has reached the deep end of the molding space 1 of its vicinity.

Furthermore, the electromagnetic device 10 may be what is called the linear motor type comprising, instead of the permanent magnets, several independent coils to which electric currents in different phases are supplied. In any case, according to this embodiment, the electromagnetic heating coils 4 and 4' and the electromagnetic device 10 for propelling the molten metal a combine to save the molten metal a from loss of fluidity due to a temperature drop and advance the molten metal a to the very end of the molding space 1 positively. Thus, high quality thin and long objects are manufactured in an efficient manner.

What is claimed is:

1. A casting apparatus comprising a mold frame formed of a non-magnetic material, molding material disposed in the mold frame, a mold disposed in the molding material defining a molding space into which a molten metal is injected, an electrical conductor for electromagnetic induction heating disposed peripherally of the mold frame, and a magnet device including oppositely disposed magnets mounted along said mold frame to generate lines of magnetic force in a magnetic field therebetween across said mold, said conductor comprising two electromagnetic coils positioned along said mold frame on opposite ends of said magnet device.

2. A casting apparatus as set forth in claim 1 wherein: the inner surface of said mold includes a coating of metal powder.

3. A casting apparatus as set forth in claim 1 wherein: said molding material is sand.

4. A casting apparatus as set forth in claim 3 wherein: the inner surface of said mold includes a coating of metal powder.

* * * * *